US005759060A

United States Patent [19]

Wu

[11] Patent Number: 5,759,060

[45] Date of Patent: Jun. 2, 1998

[54] INSULATION DISPLACEMENT CONTACT CONNECTOR

[75] Inventor: Kun-Tsan Wu, Tu Chen, Taiwan

[73] Assignee: Hon Hai Precision Ind. Co. Ltd., Taiwan

[21] Appl. No.: 587,025

[22] Filed: Jan. 16, 1996

[51] Int. Cl.[6] ..... H01R 4/24

[52] U.S. Cl. ..... 439/405

[58] Field of Search ..... 439/404, 405, 439/456, 459

[56] References Cited

U.S. PATENT DOCUMENTS 4,548,460 10/1985 Dozsa et al. ..... 439/459

5,338,221 8/1994 Bowen et al. ..... 439/405

*Primary Examiner*—Khiem Nguyen

*Assistant Examiner*—Yong Ki Kim

[57] ABSTRACT

An Insulation Displacement Contact Connector (10) includes a housing (12) with a plurality of contacts (16) therein wherein the housing (12) has a mating end (18) and an opposite connection end (22) for respective engagement with a complementary connector and flat cable (100) therewith. Each contact (16) has a mating section (30) adapted to be positioned in the mating end (18) of the connector (10), and an attachment section (32) adapted to be positioned in the connection end (22) of the connector (10). An auxiliary support (52) is securely attached to and substantially disposed within the connection end (22) of the connector (10) for efficiently maintaining the contacts (16) in position especially in the lengthwise direction of the contact (16). A cover (28) is attached to the connection end (22) of the connector (10) wherein the auxiliary support (52)is substantially embedded within the housing (12) and covered by the cover (28).

13 Claims, 6 Drawing Sheets

INSULATION DISPLACEMENT CONTACT CONNECTOR

BACKGROUND OF THE INVENTION

1. Field of the Invention

The invention relates to Insulation Displacement Contact (IDC) connector, and particularly to the IDC connector having an auxiliary support for supportably aligning the contacts thereof.

2. The Prior Art

Insulation Displacement Contact connectors (IDCs) are the existing products and have been popularly used with flat cables for several years in the computer field. The traditional IDC connector 1 can be referred to U.S. Pat. No. 4,938,711 and is shown in FIG. 1, which generally includes a housing 9 having at least to rows of contacts 4 therein wherein the housing 9 has a mating end 2 having mating sections 5 of the contacts 4 therein for receiving a complementary connector, and a connection end 3 having attachment sections 6 of the contacts 4 therein and cooperation with a cover 7 for electrical and mechanical attachment of a flat cable 8 therewith.

There are two disadvantages in the aforementioned IDC connector. The first is that the contacts 4 have no sufficient support thereabout to resist forces applied to the mating sections 5 of the contacts 4 along the lengthwise direction of the contact 4 when the complementary connector is inserted into the mating end 2 of the connector 1. Thus, the engagement between the attachment sections 6 of the contacts 4 and the corresponding flat cable 8 around the connection end 3 of the connector 1 may be influenced due to the possible vibration or misplacement of the attachment sections 6 of the contacts 3 which results from improper or misaligned insertion of the complementary connector into the mating end 2 of the connector 1.

Secondly, the pulling force may be imposed on the flat cable 8 and will directly effect the correct engagement between the attachment sections 6 of the contacts 3 and the flat cable 8.

Therefore, an object of the invention is to provide the IDC connector with an auxiliary support which can efficient resist the improper forces imposed and transferred along the lengthwise direction of the contacts.

Another object of the invention is to provide the IDC connector with a strain relief which can be easily attached to the housing of the connector and can efficiently resist the lateral forces on the attachment sections of the contacts due to pulling the flat cable.

Both above objects are desired to assure a reliable and consistent engagement between the attachment sections of the contacts and the flat cable.

SUMMARY OF THE INVENTION

According to an aspect of the invention, an Insulation Displacement Contact connector includes a housing with a plurality of contacts therein wherein the housing has a mating end and an opposite connection end for respective engagement with a complementary connector and flat cable therewith. Each contact has a mating section adapted to be positioned at the mating end of the connector, and an attachment section adapted to be positioned in the connection end of the connector. An auxiliary support is securely attached to and substantially disposed within the connection end of the connector for efficiently maintaining the contacts in position especially in the lengthwise direction of the contact. A cover is attached to the connection end of the connector wherein the auxiliary support is substantially embedded within the housing and covered by the cover.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
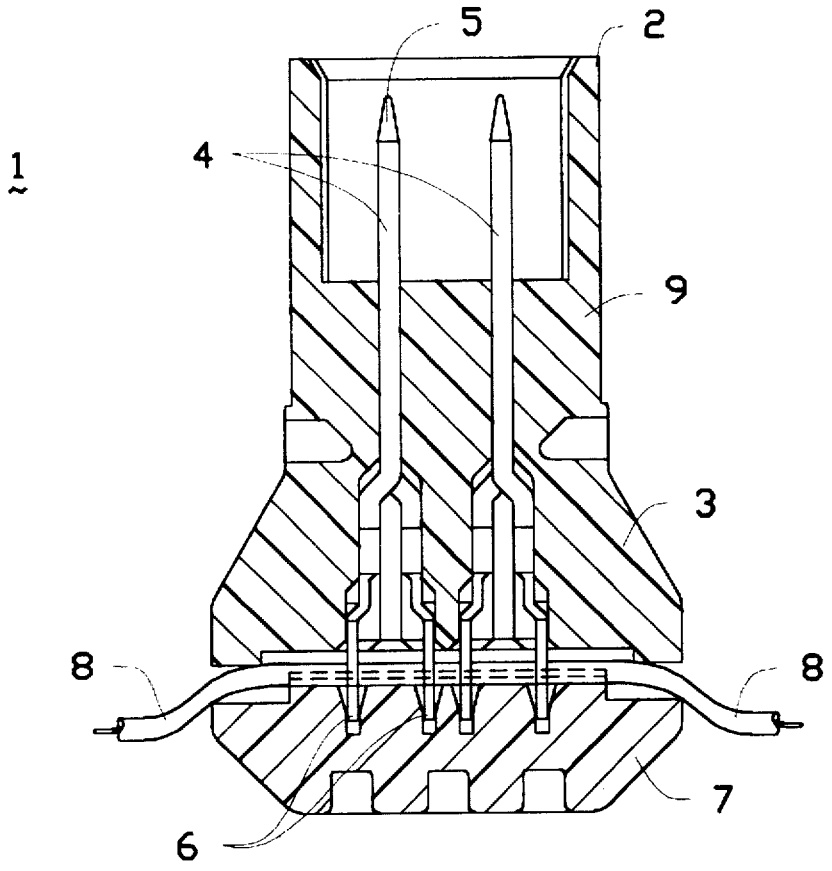
FIG.1 (PRIOR ART)
FIG. 1 is a cross-sectional view of an IDC connector of the prior art.
Figure 2:
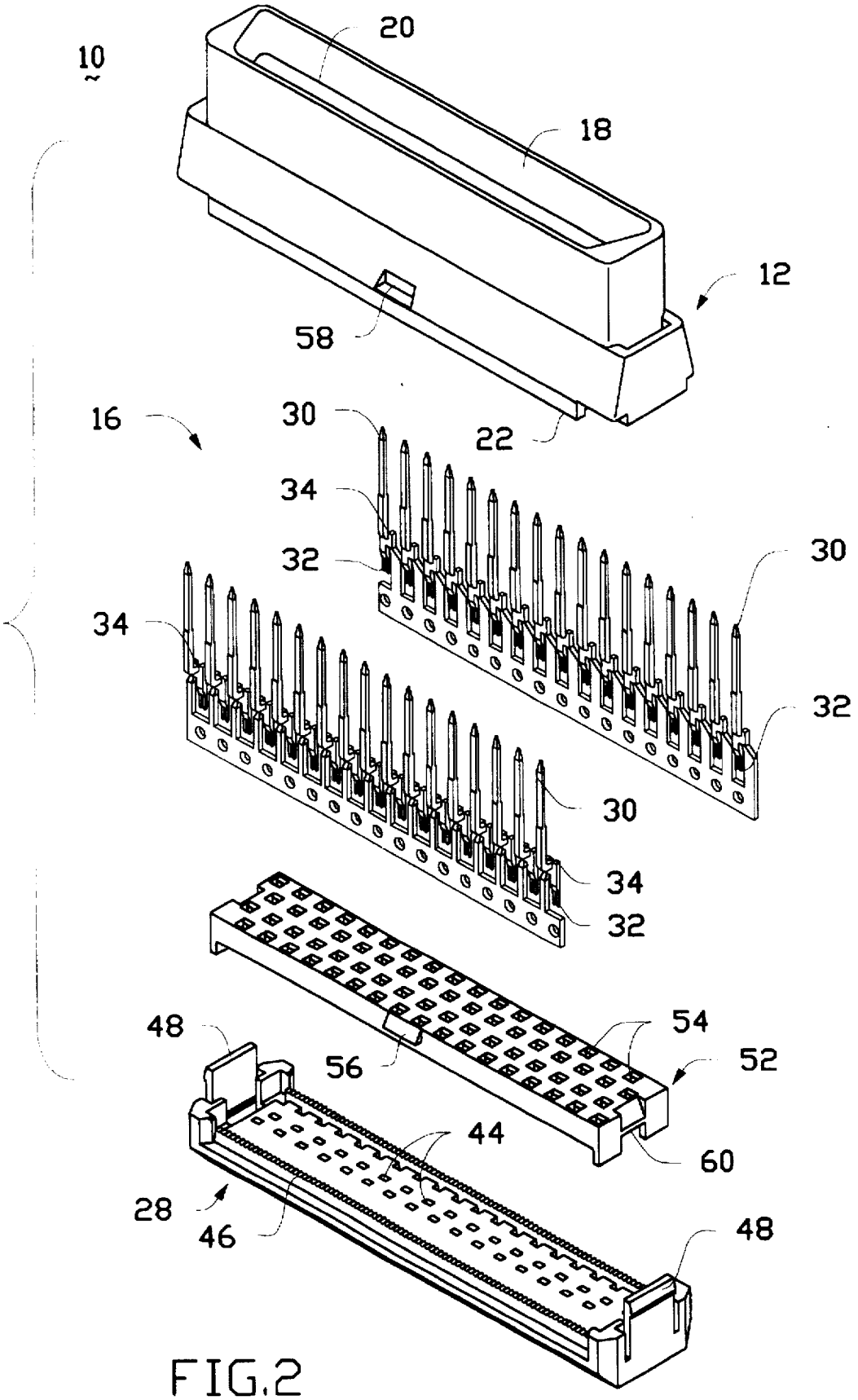
FIG. 2 is an exploded perspective view of a presently preferred embodiment of an IDC connector according to the invention wherein the contacts as shown have not been removed and cut from their carrier.
Figure 3:
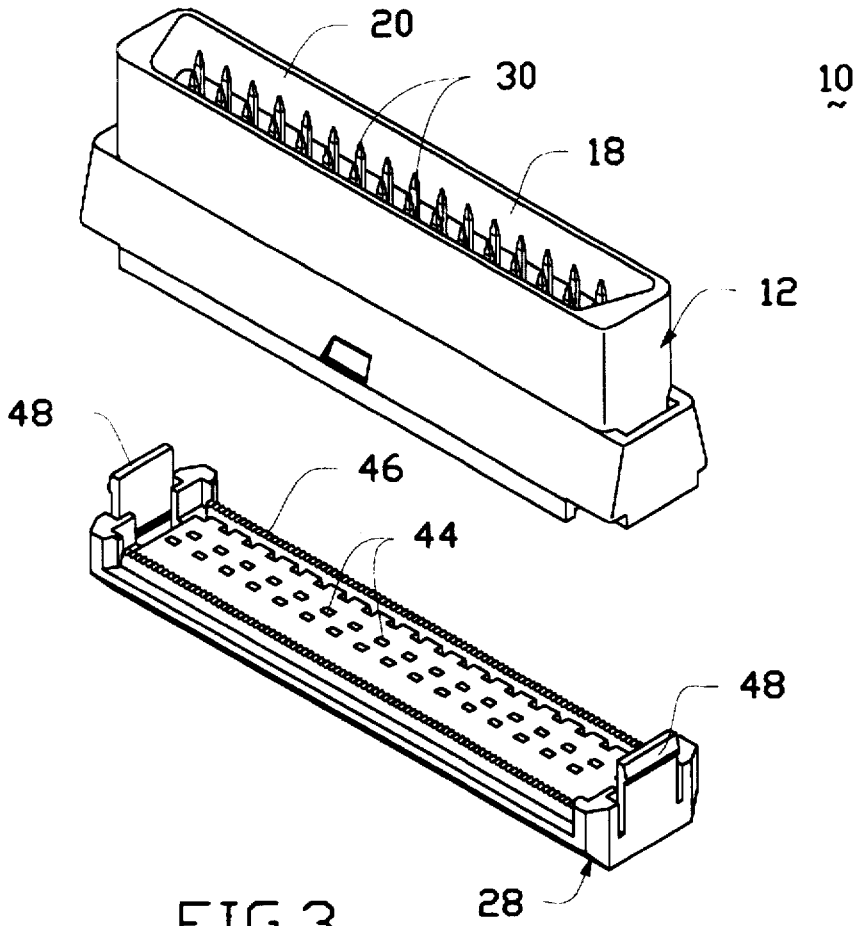
FIG. 3 is a perspective view of the IDC connector of FIG. 2 wherein the connector has been assembled together except the cover.
Figure 5:
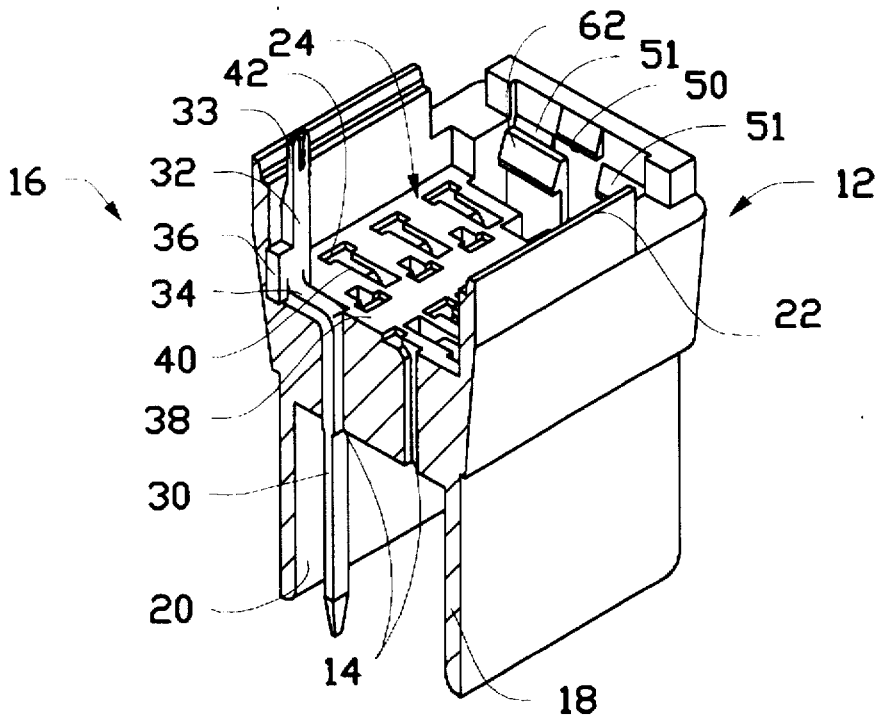
FIG. 5 is a fragmentary perspective view of the housing of the connector with contacts therein to show how the underside structure of the housing incorporates the contacts for securement consideration.

It will be noted here that for a better understanding, most of like components are designated by like reference numerals throughout the various figures in the embodiments. Attention is directed to FIGS. 2, 3 and 5, wherein an IDC connector 10 includes a housing 12 having a plurality of passageways 14 for receiving a corresponding number of contacts 16 therein. The housing 12 includes a mating end 18 defining a first cavity 20 for receiving a complementary connector (not shown) therein, and a connection end 22 defining an opposite second cavity 24 for receiving an auxiliary support 52 therein.

Figure 4:
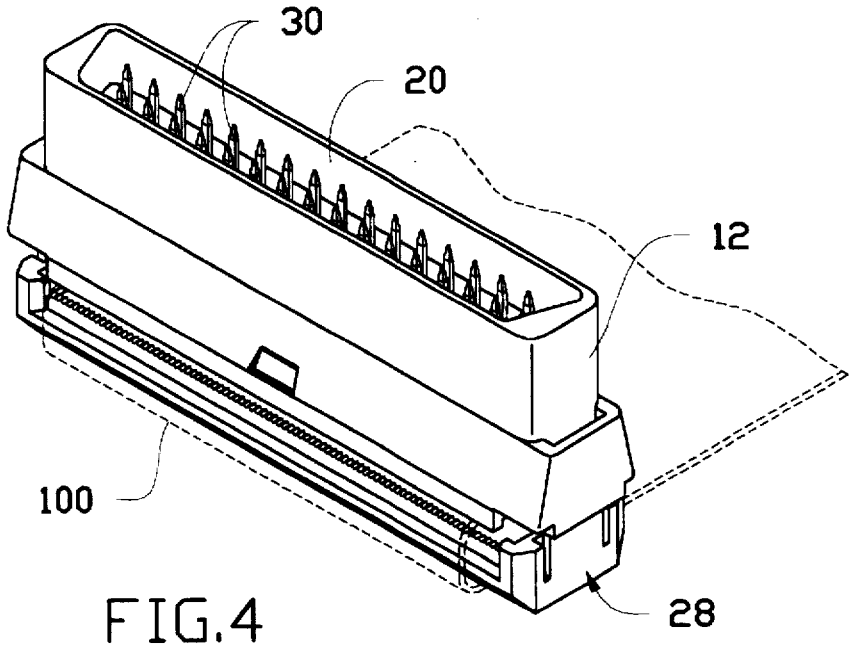
FIG. 4 is a perspective view of the IDC connector of FIG. 2 wherein a flat cable is attached thereto with the cover being ready to be in a permanent fixed position with regard to the housing of the connector.
Figure 6:
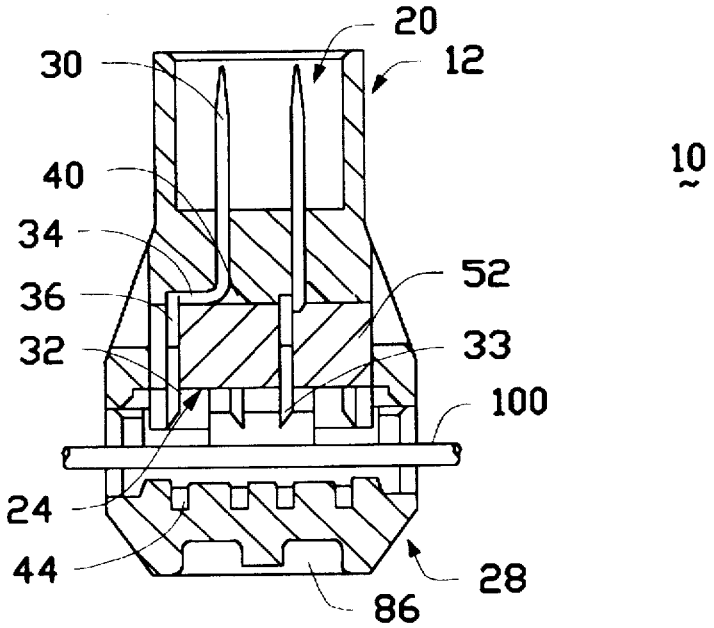
FIG. 6 is a cross-sectional view of the connector of FIG. 4 with the flat cable therein for being ready to have the cover attached to the housing in the fixed position.

Referring to FIGS. 5 and 6, each contact 16 has a mating section 30 extending through the corresponding passageway 14 and into the first cavity 20 for electrical engagement with the contacts of the complementary connector inserted within the first cavity 20, and a fork-shaped attachment section 32 extending into the connection end 22 of the connector 10 for attachment with the flat cable 100 as shown in FIGS. 4 and 6. An intermediate section 34 is positioned between the mating section 30 and the attachment section 32 wherein such intermediate section 34 is perpendicular to both of the mating section 30 and the attachment section 32 and has a pair of protrusions 36 positioned on two sides and joined with the attachment section 32. Correspondingly, the undersurface 38 of the housing 12 includes a channel 40 extending horizontally in alignment with each of the passageways 14 and with two indents 42 thereof for receiving the corresponding intermediate section 34 and the pair of protrusions 36 therein.

Referring to FIGS. 2, 3 and 6, a cover 28 is adapted to be attached to the connection end 22 of the connector 10, and includes a plurality of recesses 44 corresponding to and in alignment with the attachment sections 32 of the contacts 16. A plurality of shallow arc-shaped slot 46 are disposed on two sides of the cover 28 for compliance with the round outer shape of the flat cable 100. A pair of latches 48 are formed on two opposite ends of the cover 28 for respectively latchable engagement with the locking blocks 50 and 51 at two levels.

A plate-like auxiliary support 52 is provided within the second cavity 24 and has a plurality of holes 54 in alignment with and for receiving the corresponding attachment sections 32 of the contacts, respectively. To secure the auxiliary support 52 to the housing 12 of the connector 10, the support 52 includes a pair of latching projections 56 on two sides for engagement within a pair of corresponding openings 58 in the housing 12, and further includes a pair of steps 60 for latchable engagement with the hooks 62 (FIG. 5) downward extending from the housing 12.

When assembled, referring to FIGS. 2, 3, 5 and 6, the contacts 16 first are inserted into the housing 12 wherein the mating section 30 of each contact 16 extends through the corresponding passageway 14 and into the first cavity 20, the attachment section 32 of each contact 16 extends into the second cavity 24, and the intermediate section 34 is received within the channel 40 with the two side protrusions 36 embedded within the corresponding indents 42 therein. Then, the auxiliary support 52 is loaded to the housing 12 from the bottom wherein the attachment section 32 of each contact 16 may extend through the corresponding holes 54 in the auxiliary support 52 and the auxiliary support 52 can be locked within the second cavity 24 in the housing 12 through the engagement of the latching projections 56 of the auxiliary support 52 within the openings 58 in the housing 12, and through the engagement of the hooks 62 of the housing 12 with the steps 60 of the auxiliary support 52. Under this situation, the contacts 16 are reliably supported by the auxiliary support 52 and the housing 12 without the possibility of lateral or lengthwise movement.

Successively, the cover 28 is attached to the connection end 22 of the connector 10 with its latches 48 engaging the lower locking block 50 of the housing 12 for arranging the connector 10 as in the first temporary locking stage. In this condition, there is a space between the housing 12 and the cover 52. Lastly, the flat cable 100 is horizontally inserted into this space as shown in FIG. 6, and the cover 52 is upward moved toward the housing 12 whereby the attachment sections 32 of the contacts 16 pierce through the jacket and into the cores of the flat cable 100 and the tips 33 of the attachment sections 32 can be received within the corresponding recesses 44 in the cover 28. Thus, the flat cable 100 is substantially positioned between the housing 12/the auxiliary support 52 and the cover 28 wherein the cover 28 is arranged in the second permanent locking stage with its latches 48 engaging the upper locking blocks 51 of the housing 12.

It can be understood that because the intermediate section 34 of each contact 16 is snugly received within the corresponding channel 40 with the side protrusions 36 within the indents 42, and the back side of the intermediate section 34 of the contact 16 is strongly supported by the auxiliary support 52, the attachment section 32 of the contact 16 will not be improperly influenced by any inappropriate force imposed on the contact 16 along its lengthwise direction due to mating of the complementary connector with the subject IDC connector 10.

Figure 7:
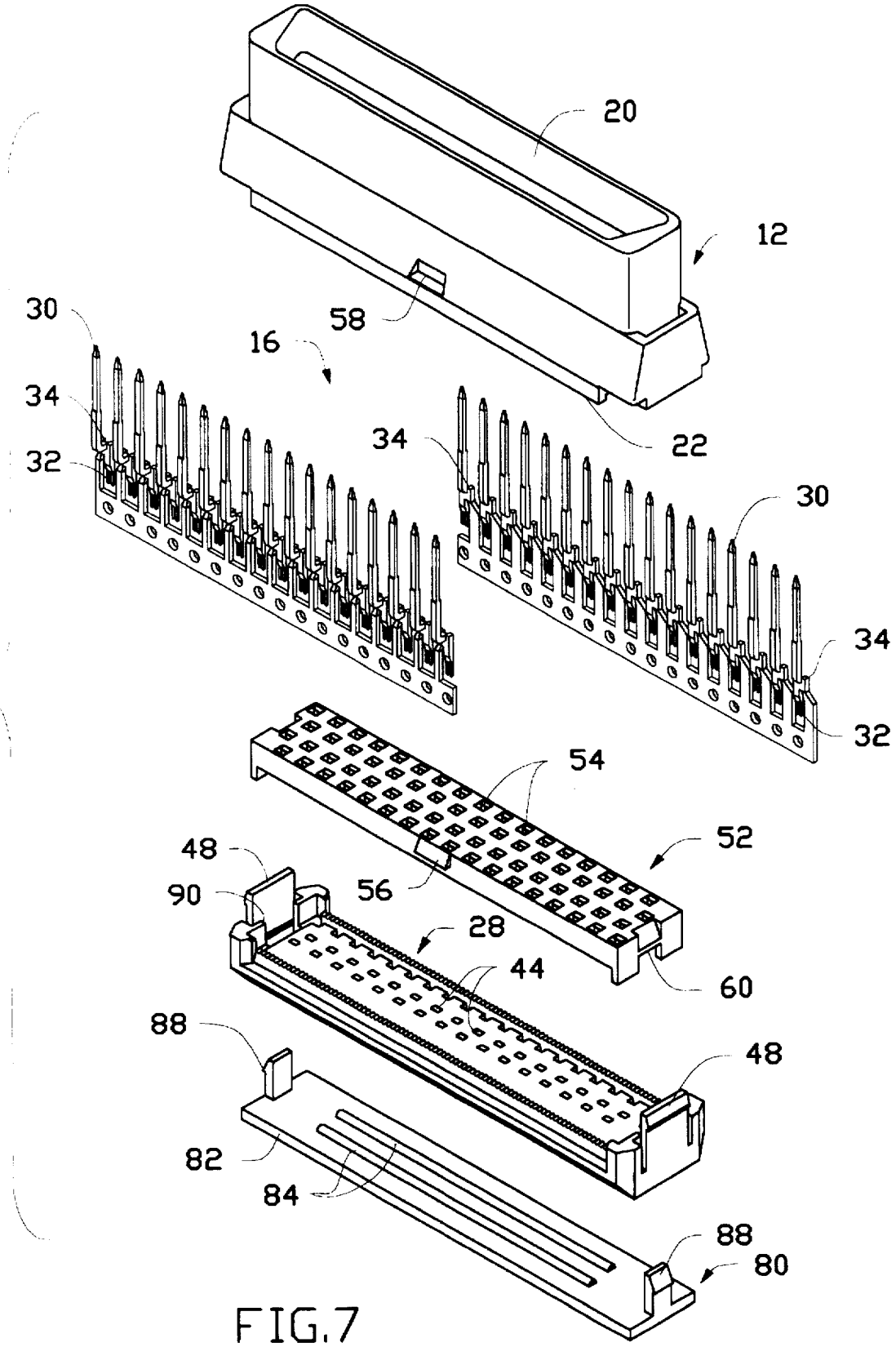
FIG. 7 is a second presently preferred embodiment of the IDC connector according to the invention.
Figure 8:
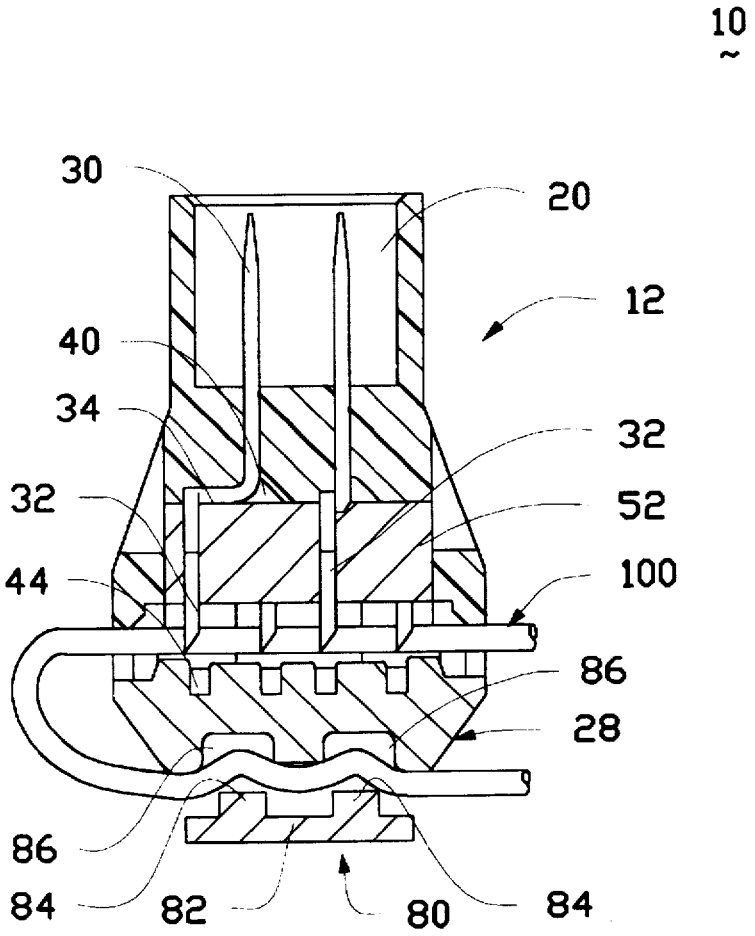
FIG. 8 is a cross-sectional view of the connector of FIG. 7 to show how the strain relief cooperates with the cover to sandwich the flat cable therebetween.

Referring to FIGS. 7 and 8, another embodiment is further provided with a strain relief 80 cooperating with the cover 28. Such strain relief 80 includes a plate body 82 having a pair of elongated strips 84 for engagement within the corresponding shallows 86 in the cover 28. The strain relief 80 further includes a pair of securement latches 88 on two opposite ends for engagement within a corresponding pair of apertures 90 positioned by the inner sides of latches 48 of the cover 28. Therefore, after permanently fastening the cover 28 to the housing 12, an exposed portion of the flat cable 100 is back folded on the cover 28, and the strain relief 80 is attached and locked onto the cover 28 by means of the securement latches 88 within the apertures 90 in the cover 28, and whereby the flat cable 100 sandwiched between the cover 28 and the strain relief 80 and pressed by the strips 84, is securely and compactly squeezed within the shallows 86 in the cover 28. Understandably, the pull force applied to the free end of the flat cable 100 will be absorbed by the strain relief 80 and will not transferred to the attachment sections 32 of the contacts 16 so that the engagement between the flat cable 100 and the connector 100 will not be jeopardized.

While the present invention has been described with reference to specific embodiments, the description is illustrative of the invent and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

I claim:

1. An Insulation Displacement Contact (ID) connector comprising:

a housing having a plurality of passageways for receiving a corresponding number of contacts therein;

each of said contact having a mating section and an attachment section;

said housing comprising a mating end defining a first cavity for receiving a complementary connector, and a connection end defining a second cavity;

a cover adapted to be fastened to said connection end of the connector and have a flat cable sandwiched therebetween; and an auxiliary support embedded within the second cavity for supportably aligning the attachment sections of the contacts within the connector.

2. The connector as described in claim 1, wherein said auxiliary support includes a plurality of alignment holes in alignment with the corresponding attachment sections of the contacts.

3. The connector as described in claim 1, each of said contacts further includes an intermediate section extending orthographic to a lengthwise direction of the mating section and the attachment section of the contact and substantially abutting against the auxiliary support.

4. The connector as described in claim 3, wherein said housing further includes a plurality of channels laterally extending on an undersurface thereof in alignment with the corresponding passageways for receiving the corresponding intermediate sections of the contacts, respectively.

5. The connector as described in claim 1, wherein the auxiliary support includes latching projections and steps for respectively latchable engagement with openings and hooks of the housing so that the auxiliary support can be fastened to the housing.

6. The connector as described in claim 1, wherein said connector further includes a strain relief attachably positioned on the cover, and said strain relief includes strips adapted to press against said flat cable within corresponding shallows in the cover when said strain relief is completely secured to said cover.

7. An auxiliary support for use within an ID connector wherein said connector includes a housing having a plurality of contacts therein, each of said contacts having an attachment section for piercing into a flat cable, said housing having first fastening means; said auxiliary support comprising a plate-like body having a plurality of alignment holes in alignment with and for reception of said attachment sections of the contacts of the connector, and second fastening means for latchable engagement with said first fastening means of the housing of the connector.

8. An arrangement of supportably aligning a plurality of attachment sections of contacts in an ID connector, said connector including housing having a mating end for engagement with a complementary connector and a connection end for attachment to a flat cable, each of said contact including a mating section proximate said mating end and opposite to said attachment section which is generally positioned proximate the connection end, an intermediate section being substantially positioned between the corresponding mating section and attachment section of each of contacts, and an auxiliary support being provided proximate the connection end for providing a support surface to butt said intermediate section of each contact so that a force imposed on the mating section of the contact in a lengthwise direction may not influence the attachment section.

9. The arrangement as described in claim 8, wherein said intermediate section is generally perpendicular to the corresponding mating section and attachment section.

10. An ID connector for use with a flat cable, comprising:

a housing defining a mating end and a connection end and having a plurality of contacts therein wherein each contact has a mating section, an opposite attachment section and an intermediate section therebetween;

a cover adapted to be attached to said connection end;

an auxiliary support positioned between the cover and the housing;

first means for fastening the cover to the housing; and second means for fastening the auxiliary support to the housing.

11. The connector as described in claim 10, wherein said first means includes latches on the cover and the locking blocks on the housing.

12. The connector as described in claim 10, wherein said second means includes latching projections of the auxiliary support and openings in the housing.

13. The connector as described in claim 12, wherein said second means further includes hooks on the housing and steps on the auxiliary support.

* * * * *